United States Patent [19]

Kobayashi et al.

[11] Patent Number: 4,873,548

[45] Date of Patent: Oct. 10, 1989

[54] IMAGE FORMING APPARATUS COMPRISING A MAIN ASSEMBLY HAVING A TOP FRAME ADAPTED TO SWING OPEN AND CLOSED WITH RESPECT TO A BOTTOM FRAME AND HAVING PROCESS CARTRIDGE DETACHABLY MOUNTED IN THE MAIN ASSEMBLY

[75] Inventors: Hiroo Kobayashi; Hitoshi Fujino, both of Tokyo; Tadashi Yagi, Kawasaki; Nobukazu Adachi, Tokyo; Yasuyoshi Hayakawa; Takeshi Setoriyama, both of Yokohama, all of Japan

[73] Assignee: Canon Kabushiki Kaisha, Tokyo, Japan

[21] Appl. No.: 319,893

[22] Filed: Mar. 7, 1989

Related U.S. Application Data

[63] Continuation of Ser. No. 869,872, Jun. 3, 1986, abandoned.

[30] Foreign Application Priority Data

Jun. 6, 1985 [JP] Japan ..... 60-123060

[51] Int. Cl.[4] ..... G03G 15/00

[52] U.S. Cl. ..... 355/200; 355/211; 346/160

[58] Field of Search ..... 355/200, 211, 228; 346/160

[56] References Cited

U.S. PATENT DOCUMENTS

| | | | |
|---|---|---|---|
| 3,966,316 | 6/1976 | Pfeifer et al. | 355/3 R |
| 4,124,289 | 11/1978 | Miyata et al. | 355/8 X |
| 4,297,713 | 10/1981 | Ichikawa et al. | 355/3 R X |
| 4,500,195 | 2/1985 | Hosono | 355/30 R X |
| 4,544,260 | 10/1985 | Kolbe | 355/3 BE |
| 4,609,276 | 9/1986 | Mitzutani | 355/30 R X |
| 4,609,277 | 9/1986 | Yokoyama et al. | 355/3 R |
| 4,634,264 | 1/1987 | Takahashi | 355/3 R X |
| 4,668,072 | 5/1987 | Yasuda | 355/3 R |
| 4,673,956 | 6/1987 | Kobayashi | 355/30 R X |
| 4,785,319 | 11/1988 | Fujino et al. | 346/160 |

FOREIGN PATENT DOCUMENTS

| | | | |
|---|---|---|---|
| 59-77450 | 5/1984 | Japan | 355/14 SH |

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image forming apparatus provided with a positioning mechanism for positioning a process cartridge in the main assembly. The process cartridge is detachably mountable into the main assembly. The main assembly includes a bottom frame and a top frame which is capable of taking a closing position and an opening position. The process cartridge is loaded into the top frame or bottom frame. Prior to the start of image formation, the process cartridge is correctly positioned with respect to the bottom frame. The bottom frame contains the major part of the optical system, whereby the accurate relative position can be accomplished with an optical system of the cartridge.

18 Claims, 11 Drawing Sheets

IMAGE FORMING APPARATUS COMPRISING A MAIN ASSEMBLY HAVING A TOP FRAME ADAPTED TO SWING OPEN AND CLOSED WITH RESPECT TO A BOTTOM FRAME AND HAVING PROCESS CARTRIDGE DETACHABLY MOUNTED IN THE MAIN ASSEMBLY

This application is a continuation of application Ser. No. 869,872 filed June 3, 1986, now abandoned.

FIELD OF THE INVENTION AND RELATED ART

The present invention relates to an image forming apparatus usable with a process cartridge which contains a photosensitive member and at least one of an image forming means such as a developing device, a cleaning device, and charger, which are integrally supported on the process cartridge. The image forming apparatus can produce on a recording material an image of characters and figures as in a computer, facsimile, personal computer, electrophotographhic copying machine and a word processor and the like.

An image forming apparatus usable with such a process cartridge has been made practicable, wherein the main apparatus is divisible or openable to allow easy mounting and dismounting of the process cartridge, such that the process cartridge is loaded on the upper frame of the main assembly.

In this type of the apparatus, since the cartridge is disposed with the major components of the optical system in the upper frame, the upper frame becomes heavy, with the result of a bulky supporting mechanism for the upper frame. Further, the vibration at the time of opening and closing the upper frame distorts the optical system, which leads to a non-uniform scanning operation and the inability to produce a sharp exposure of the image. Furthermore, the toner can be scattered from the cartridge.

SUMMARY OF THE INVENTION

Accordingly, it is a principal object of the present invention to provide an image forming apparatus wherein the above-described problems with the conventional image forming apparatus using a process cartridge are solved.

It is another object of the present invention to provide an accurate positioning mechanism for the optical member provided in the upper frame which is openable with respect to the bottom frame.

It is another object of the present invention to provide a simple mounting and dismounting mechanism for the process cartridge.

According to an embodiment of the present invention, an image forming apparatus is provided, which comprises a main assembly including a bottom, frame and a top frame which is capable of assuming closing and opening positions with respect to the bottom frame; a process cartridge detachably mountable into the main assembly and containing at least a photosensitive member and process means contributable to image formation on the photosensitive member; optical means provided in the bottom frame for applying light information to the photosensitive member of the cartridge; a positioning member provided in the bottom frame and engageable with the cartridge when the top frame assumes its closing position; and supporting means provided in the top frame to detachably support the cartridge.

When the apparatus comprises an upper frame openable with respect to the bottom frame, it is advantageous that the optical members such as mirrors or the like are positioned on the bottom frame by abutting the optical member to a positioning member provided on the bottom frame, as in the cartridge.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
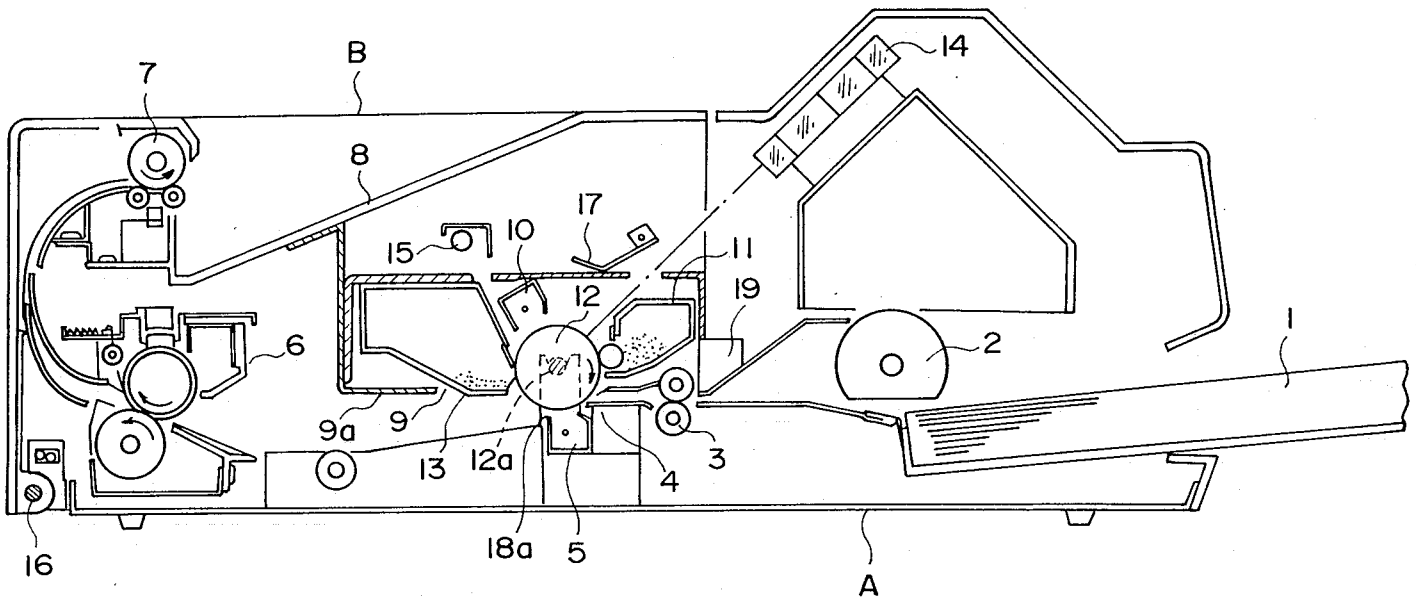
FIG. 1 is a sectional view of an image forming apparatus according to an embodiment of the present invention.

Referring to FIG. 1, there is shown an image forming apparatus according to an embodiment of the present invention. The image forming apparatus is shown as being of such a type of image forming apparatus wherein an electrophotographic photosensitive member is scanned by a laser beam for image formation, as an example of the image forming apparatus.

Figure 2:
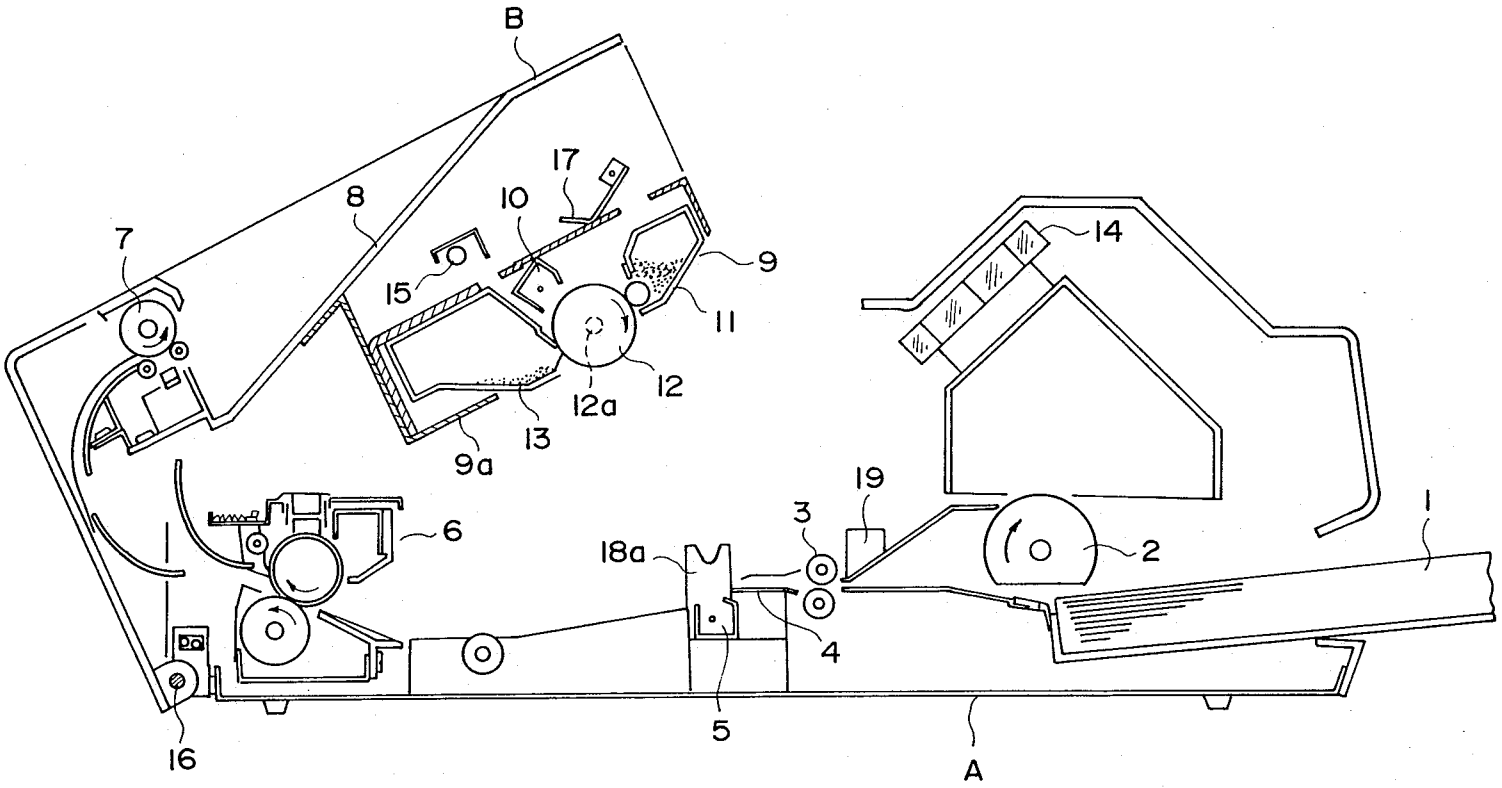
FIG. 2 is a sectional view of the apparatus of FIG. 1 when top cover is opened.
Figure 3:
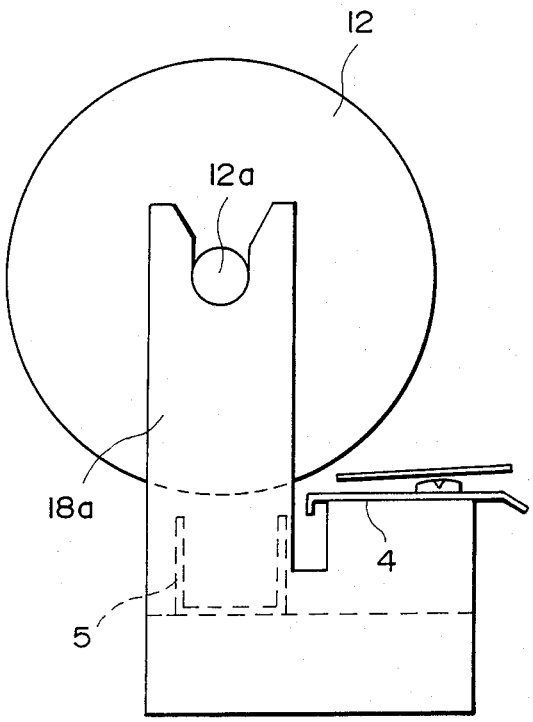
FIG. 3 is a partial side elevation of a positioning mechanism of the present invention.
Figure 4:
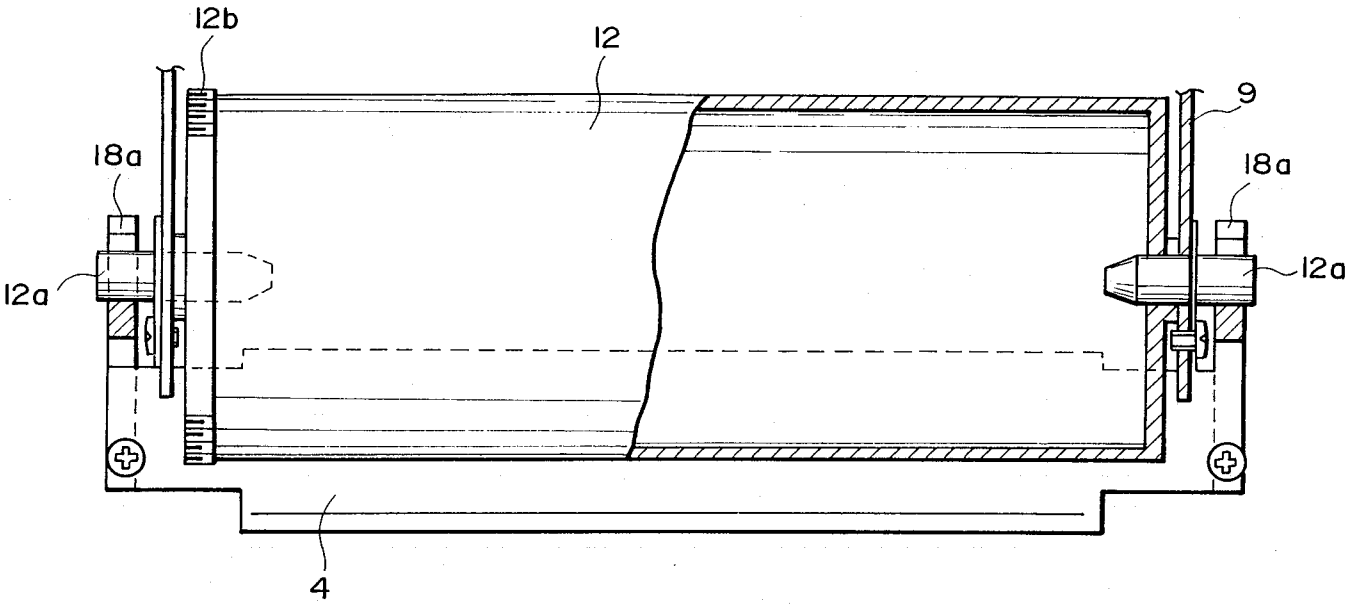
FIG. 4 is a plan view of the positioning mechanism shown in FIG. 3.

FIG. 2 illustrates the same apparatus under a different condition, that is, when the top part of the apparatus is opened.

Referring back to FIG. 1, the image forming apparatus comprises a laser scanner 14 of a known structure which scans the photosensitive drum 12. Since the laser beam carries image signals, the photosensitive drum 12 is exposed to an image. The photosensitive drum is rotatable in the direction indicated by an arrow, during which time it is uniformly charged by a corona charger 10. After being uniformly charged thereby, the photosensitive drum 12 is exposed to the image-modulated laser beam by the laser scanner 14, so that an electrostatic latent image is formed on the photosensitive drum 12, which image is in turn developed by the toner of the developing device 11. In this example, a process cartridge 9 is illustrated as containing as a unit the photosensitive drum 12, the developing device 11, cleaning device 13 and the charger 10 which are supported on a frame. A transfer material or sheet 1 on which the image is to be recorded, is fed to the surface of the photosensitive drum 12 by a feeding roller 2, a registration roller 3 and transfer material guiding plates 4. At an image transfer station, the toner image formed on the photosensitive drum 12 is transferred to the thus fed transfer sheet by a transfer charter 5. Thereafter, the transfer sheet is separated from the photosensitive drum 12, and is then transported to an image fixing device 6, where the image now transferred onto the transfer sheet is fixed into a permanent image. Finally, the transfer sheet is discharged out of the image forming apparatus onto a tray above the cover 8 constituting a part of the top frame B. The sheet discharging is effected by a couple of the discharging rollers 7. The toner which has not been transferred onto the transfer sheet but which remains on the photosensitive drum 12 is removed therefrom by the cleaning device 13 and is collected.

The apparatus further comprises a pre-exposure lamp 15, a hinge 16 constituting a rotational axis of the cover 8, a spring 17 for urging the process cartridge 9 downwardly, a positioning block 18*a* for engaging with and supporting end shafts 12*a* and 12*b* of the photosensitive drum 12 and an abütting block 19 for stopping the rotation of the process cartridge 9.

As is best seen in FIG. 2, the top frame B and the bottom frame A of the apparatus are divisible or openable by pivotable or rotational action about the hinge 16. More particularly, in this embodiment, the top frame B can be rotated upwardly. The top frame contains the discharging rollers 7, the pre-exposure lamp 15, the process cartridge 9, the guide 9A for guiding the cartridge, the spring 17 and other elements. The bottom frame contains the feeding roller 2, the registration roller 3, the transfer sheet guides, the image fixing device 6, a laser scanner 14 for constituting the major part of the optical system, the positioning block 18*a* and the abutting block 19 and other elements. The cartridge 9 may be mounted into or dismounted from the apparatus in the direction of an axis of the photosensitive drum 12.

In FIG. 2, the process cartridge 9 is shown as simply bearing against the guide 9*a* in the top frame B, and it is urged downwardly by the spring 17 so that it does not easily come out of the guide 9*a* with the aid of an unshown stopper. In this state, the process cartridge is easily raised upwardly if it is pushed upwardly against the force of the spring 17.

When the top frame or cover is closed (FIG. 1), the shafts 12*a* provided at longitudinal opposite ends of the photosensitive drum 12 engage the groove of the positioning block 18*a* provided in the bottom frame. A part of the frame of the process cartridge 9 engages the abutting block 19 for positioning and supporting the frame of the cartridge, by which the frame of the process cartridge 9 is prevented from rotating. Further, a transfer guide plate 4 is fixed to the positioning block 18*a*, the transfer guide plate 4 is fixed, and the relative positional relation between the photosensitive drum 12 and the transfer guide plate 4 is automatically assured only by closing the top frame.

Figure 5:
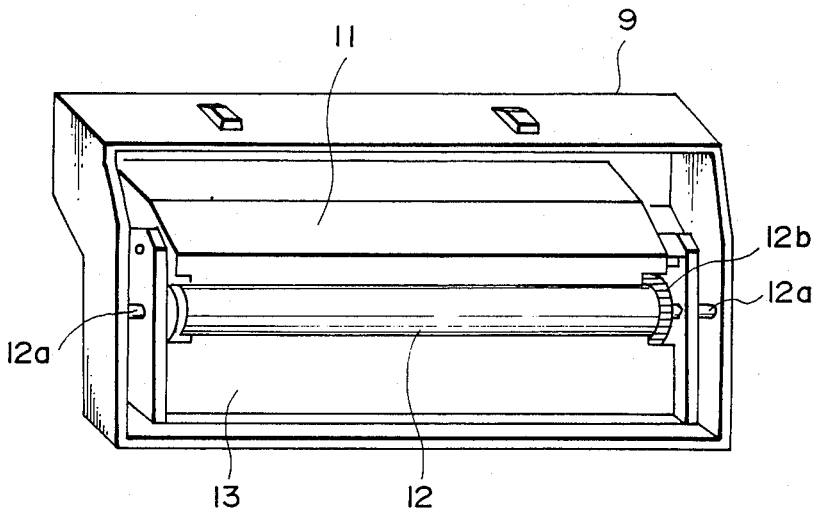
FIG. 5 is a perspective view seen from the bottom of a process cartridge.

FIG. 5 is a perspective view seen from the bottom, of the process cartridge. The cartridge includes a gear 12*b* for transmitting the driving force from the main assembly to the photosensitive drum 12. The gear is fixed to an end of the photosensitive drum 12.

Figure 6:
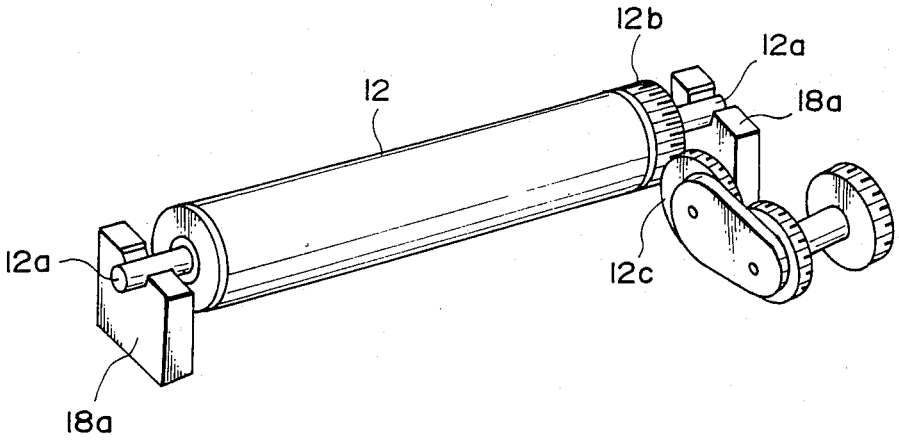
FIG. 6 is a perspective view of a driving mechanism of the present invention.

FIG. 6 is a perspective view illustrating the driving mechanism for the photosensitive drum 12. As will be understood from this Figure, the above-described gear 12*b* of the photosensitive drum meshes with a driving gear C provided in the bottom frame A so that the driving force from the bottom frame A is transmitted to the photosensitive drum 12 through those gears.

Figure 7:
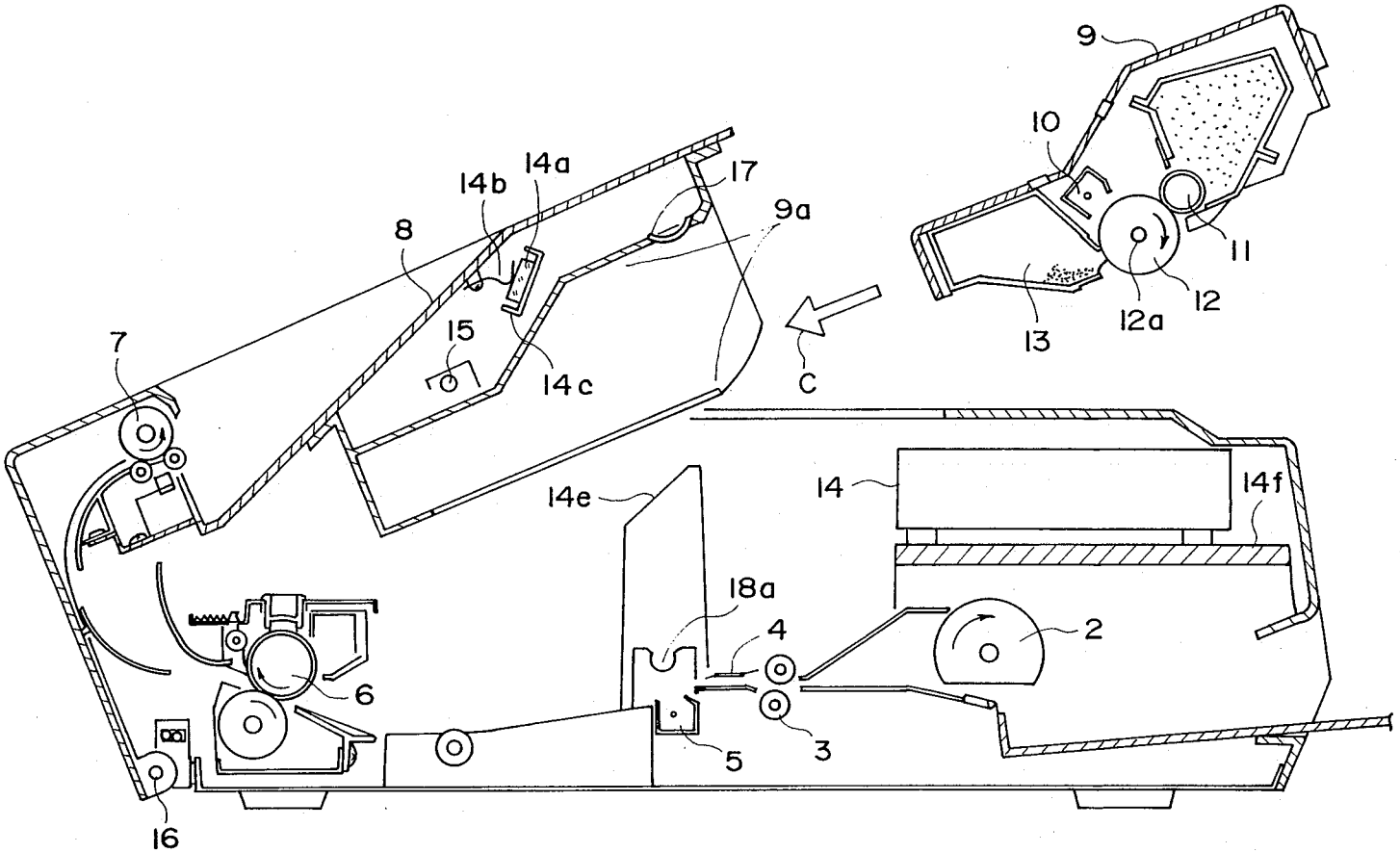
FIGS. 7 and 8 are sectional views of an apparatus of the present invention provided with a reflection mirror.

FIG. 7 illustrates an image forming apparatus according to another embodiment of the present invention. In this apparatus, a reflection mirror 14*a* as a part of the optical means is contained in the top frame, in addition to the scanner disposed in the bottom frame A. The reflection mirror 14*a* is fixedly secured to a mirror holder 14*c*.

Figure 10:
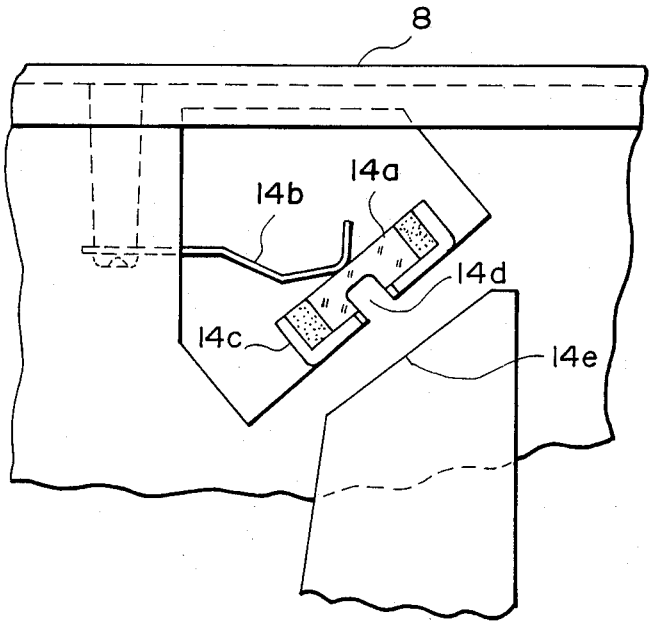
FIGS. 10 and 11 are partial side views, illustrating the reflection mirror of the present invention correctly positioned.

As shown in FIG. 10, opposite end portions of the mirror holder 14*c* are engaged with and supported by a hook 14*d* in the opening of the side wall of the top frame. Also provided is an urging spring 14*b* having an end fixed to the top frame and the other end acting on the top surface of the mirror 14*a* so as to urge it substantially downwardly.

Figure 11:
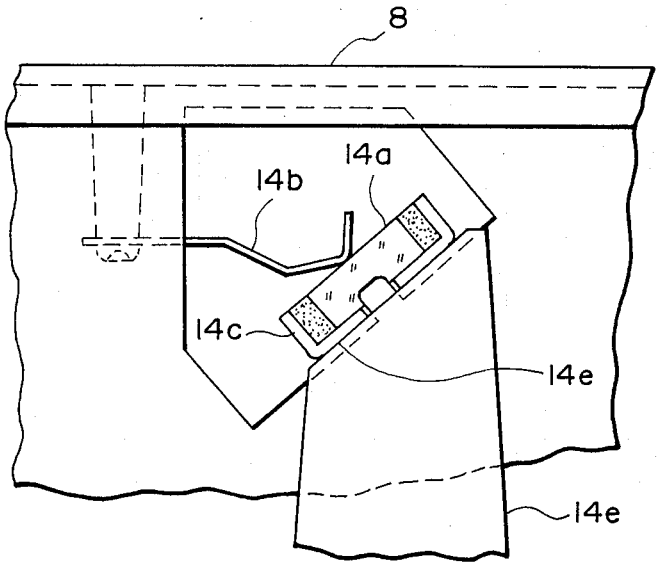

In the bottom frame, there is provided a mirror stopper having an inclined surface for engaging the bottom surfaces of the mirror holder 14*c* at the opposite ends, thus positioning the mirror 14*a* with respect to the mirror stopper, as shown in FIG. 11.

Referring back to FIG. 7, the bottom frame contains a scanner table 14*f* for supporting the laser scanner 14. The scanner table is integral with the drum shaft support 18*a* and the mirror stopper and is made of a reinforced plastic of polycarbonate with glass fibers, thus assuring the dimensional and positional accuracy and also assuring mechanical strength.

Figure 9:
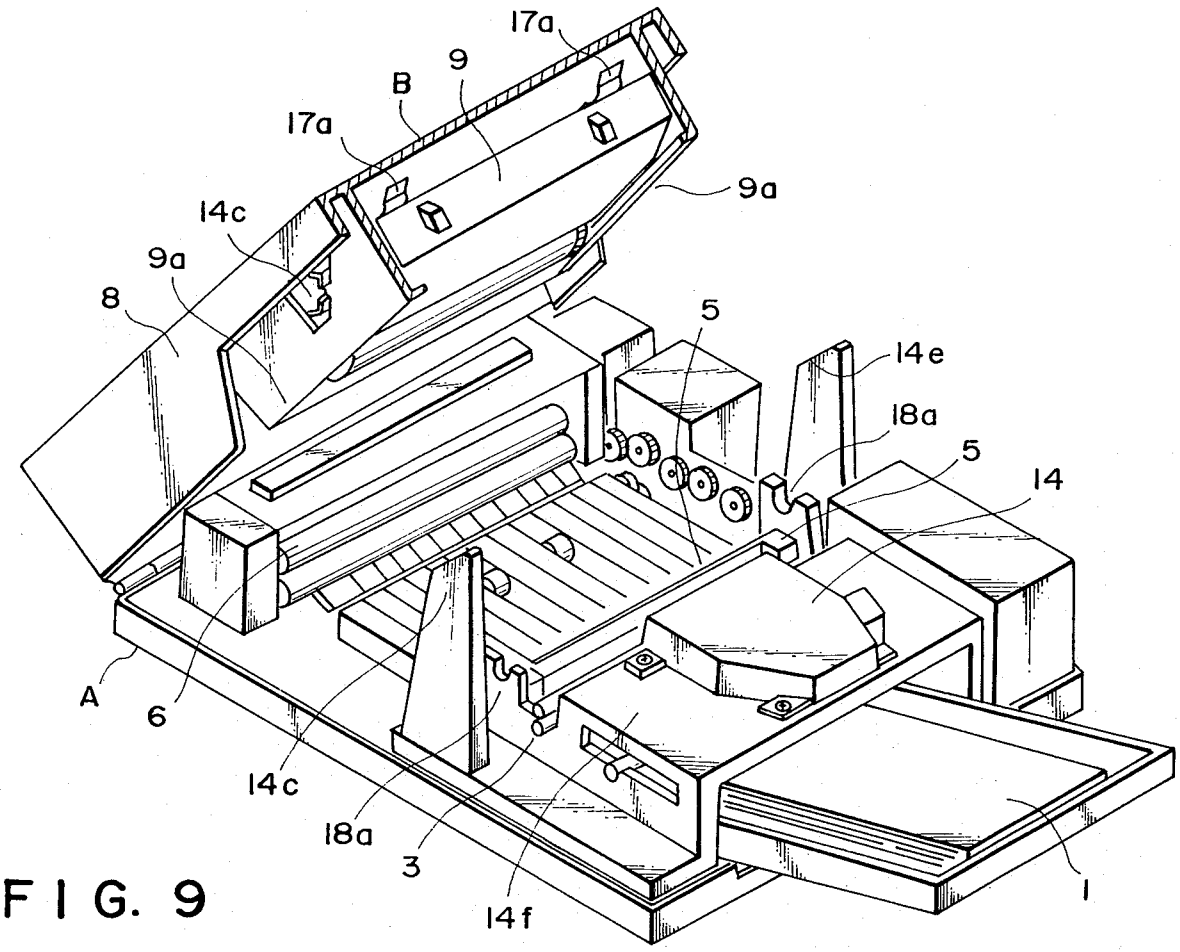
FIG. 9 is a perspective view of FIG. 7 apparatus wherein the top frame is opened.

FIG. 9 is a perspective view of the apparatus when the top frame is in the open position.

Because of the structures described above, when the top frame is in its closing position, accurate positioning can be accomplished among the laser scanner 14 as the light source, the registration roller couple 3, which is the keystone of the transfer sheet transportation, the photosensitive drum 12 and the reflection mirror 14*a*, in conjunction with the bottom frame. Additionally, mechanical strength is increased by the integral frame structure, and moreover, the vibration can be reduced greatly.

Referring back to FIG. 7, the process cartridge is inserted into the top frame in the direction indicated by an arrow C.

Figure 8:
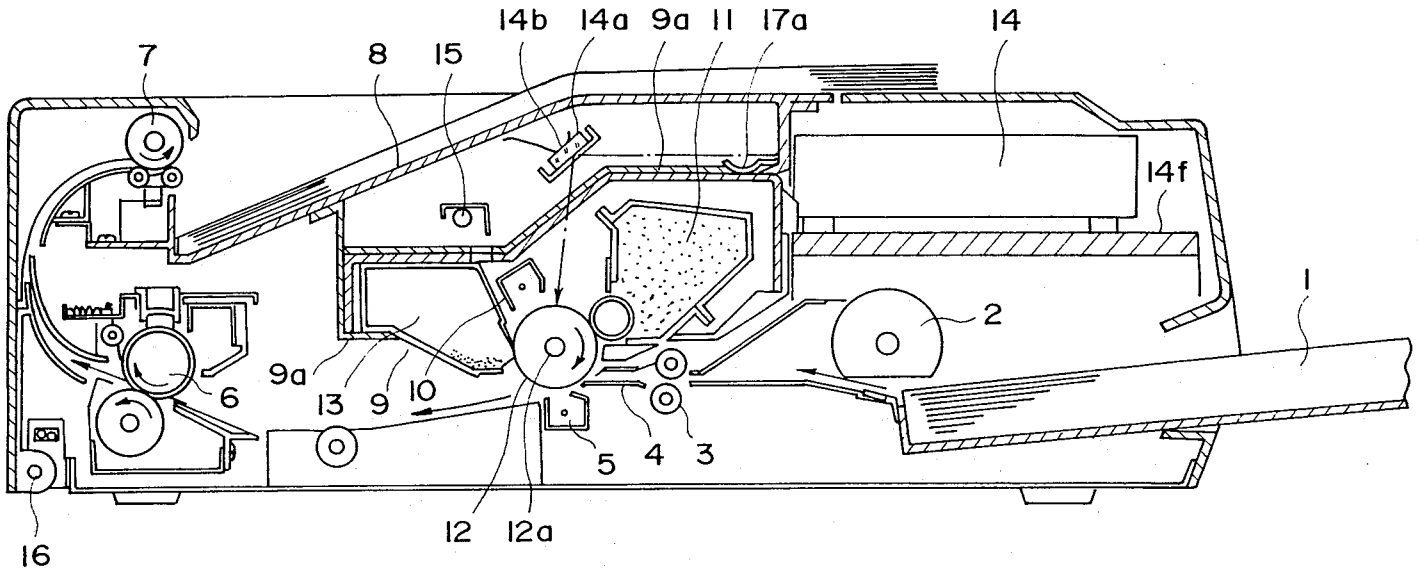

FIG. 8 illustrates the apparatus of FIG. 7 when the top frame is in its closing position, and the image forming operation is performed.

FIG. 10 illustrates the positioning of the reflection mirror 14*a* with respect to the mirror stopper 14*e*, as will be understood from the foregoing description.

FIG. 11 shows the state of mirror 14*a* after it has been positioned, as will be understood from the foregoing description.

In this embodiment, as will be understood, the shaft defining the rotational axis of the photosensitive member in the process cartridge is engaged with the positioning member provided in the bottom frame, by which the very accurate positioning is accomplished between the major part of the optical system and the process cartridge, which should be accurately positioned with the major part of the optical system. Additionally, the transfer guide plate, the transfer charter and other elements may be correctly positioned automatically and simultaneously, by providing similar mechanisms if desired. It should be noted that the major part of the optical system is not provided in the top frame, and therefore, the mechanism for rotatably connecting the top and bottom frames may be of a relatively simple structure, thus providing an image forming apparatus which is not heavy and which is easy for the operator to handle.

The apparatus shown in FIG. 7 includes the reflection mirror. Even in this structure, the process cartridge and the reflection mirror are correctly positioned with respect to the bottom frame when the top frame assumes its closing position, without employing a complicated structure for the top frame and without increasing the dimensions of the device. Additionally, various image forming means such as the laser scanner as the light source, the reflection mirror, the registration roller couple and the photosensitive drum in the process cartridge are provided in the top frame substantially as a unit, whereby they are correctly positioned with high accuracy, so that the image quality can be maintained high.

Figure 12:
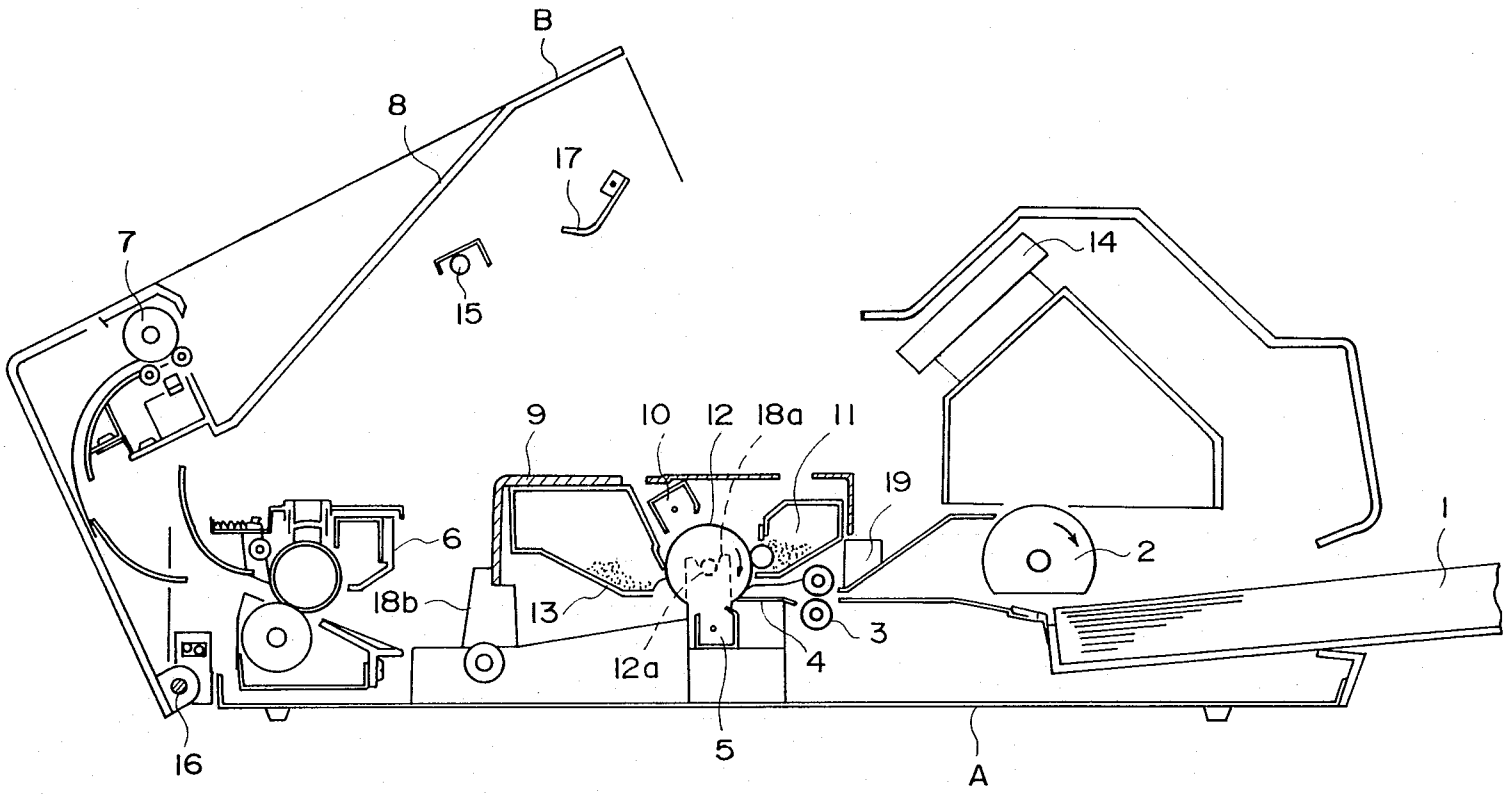
FIGS. 12 and 13 are sectional views of image forming apparatuses according to other embodiments of the present invention.

In the foregoing description of the embodiments, the process cartridge is loadable into the top frame, However, it is a possible alternative that, as shown in FIG. 12, the process cartridge is supported on a supporting member 18*b* or 19 provided in the bottom frame A, and it is urged by a spring 17 provided in the top frame when the apparatus is closed, thus positioning the process cartridge.

Figure 13:
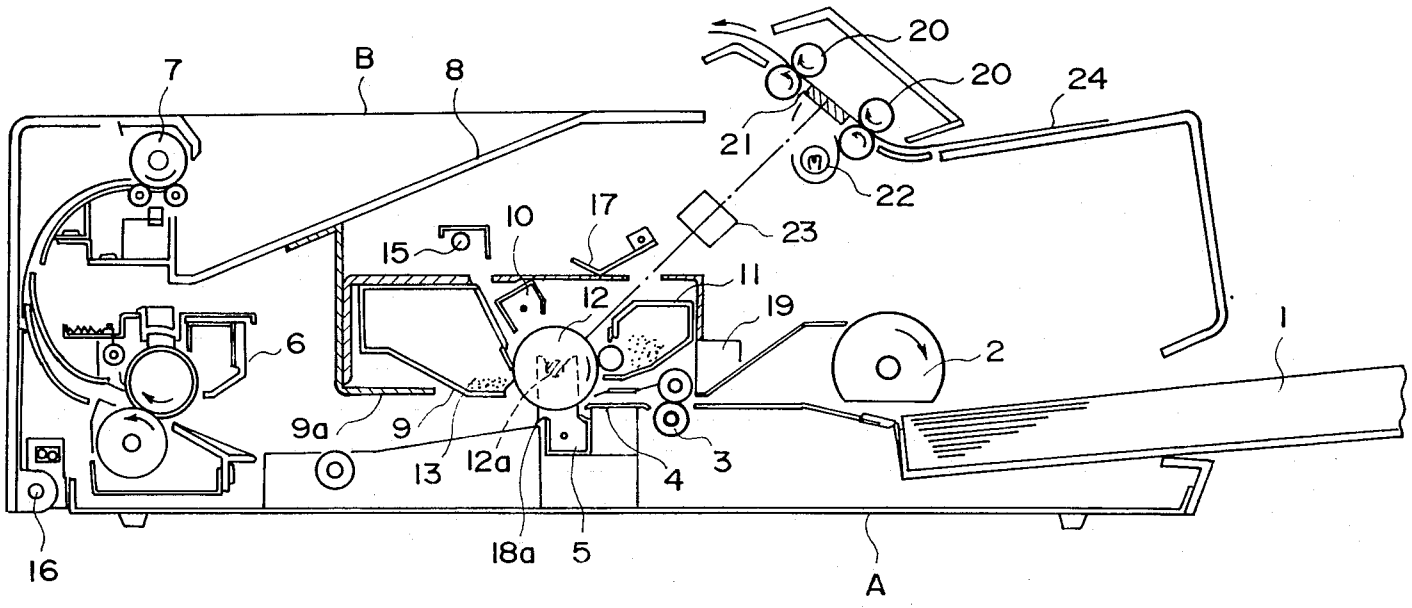

As shown in FIG. 13, sheet original scanner may be used in place of the laser scanner 14. In the FIG. 13 apparatus, the original to be copied is transported by transporting rollers by a slit glass 21. During the transportation, the original 24 is illuminated by a lamp 22, and the light reflected by the original is imaged by an imaging lens 23 and focused on the surface of the photosensitive drum 12, so that the photosensitive drum 12 is exposed to the slit image of the original. Those optical means are securely fixed on the bottom frame A. It is possible that the mirror 14*a* as used in FIG. 7 embodiment may be used in the top frame.

Figure 14:
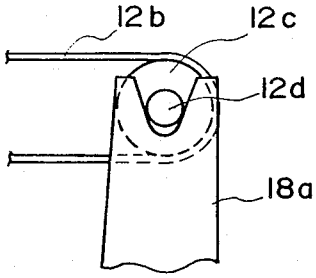
FIG. 14 is a partial side view, illustrating the positioning where a photosensitive belt is used.

As shown in FIG. 14, it is possible to use a photosensitive member in the form of a belt in place of the photosensitive drum. The above descriptions apply to the case of photosensitive belt 12*b*. The rotational axis of the photosensitive drum corresponds to the rotational axis 12*d* of a roller 12*c* for supporting the photosensitive drum. It is desirable that the roller 12*c* is disposed close to the exposure position with the view to correct positioning. As for the process cartridge, it contains as a unit two or more means to be used for image formation. For example, it may contain the photosensitive member and the developing device; the photosensitive member and the cleaning device; or the photosensitive member and the developing means and the cleaning means. The structures shown in FIGS. 13*a*–13*f* of U.S. Pat. No. 4462677 assigned to the assignee of the present application are usable with the present invention.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a main assembly including a first frame and a second frame which is adapted to assume closing and opening positions with respect to the first frame;

a process cartridge detachably mountable into the main assembly and containing at least a photosensitive member and process means contributable to image formation on the photosensitive member;

optical means provided in said first frame for applying light information to the photosensitive member of said cartridge;

a positioning member provided in said first frame and engagable with said cartridge when said second frame assumes its closing position;

supporting means provided in said second frame to detachably support said cartridge; and a spring member provided in said second frame to urge said process cartridge, when loaded, toward said positioning member.

2. An image forming apparatus comprising:

a main assembly including a first frame and a second frame which is adapted to assume closing and opening positions with respect to the first frame;

a process cartridge detachably mountable into the main assembly and containing at least a photosensitive member and process means contributable to image formation on the photosensitive member, wherein said process cartridge is inserted into and retracted from the main assembly in the direction substantially perpendicular to the central axis of the opening and the closing of said second frame;

optical means provided in said first frame for applying light information to the photosensitive member of said cartridge;

a positioning member provided in said first frame and engagable with said cartridge when said second frame assumes its closing position; and supporting means provided in said second frame to detachably support said cartridge.

3. An image forming apparatus comprising:

a main assembly including a first frame and a second frame which is adapted to assume closing and opening positions with respect to the first frame;

a process cartridge detachably mountable into the main assembly and containing at least a photosensitive member and process means contributable to image formation on the photosensitive member;

optical means provided in said first frame for applying light information to the photosensitive member of said cartridge;

a positioning member provided in said first frame and engagable with said cartridge when said second frame assumes its closing position;

wherein said positioning member integrally supports a transfer charger; and supporting means provided in said second frame to detachably support said cartridge.

4. An apparatus according to claim 3 wherein a spring member is provided in said second frame to urge said process cartridge toward said positioning member, when said second frame assumes its closing position.

5. An apparatus according to claim 3, wherein said positioning member is engageable to a rotational shaft of the photosensitive member of said cartridge.

6. An image forming apparatus comprising:

a main assembly including a first frame and a second frame which is adapted to assume closing and opening positions with respect to the first frame;

a process cartridge detachably mountable into the main assembly and containing at least a photosensitive member and process means contributable to image formation on the photosensitive member;

optical means provided in said first frame for applying light information to the photosensitive member of said cartridge;

a positioning member provided in said first frame and engagable with said cartridge when said second frame assumes its closing position, wherein said positioning member integrally supports a transfer charger and a transfer material guide; and supporting means provided in said second frame to detachably support said cartridge.

7. An image forming apparatus, comprising:

a main assembly including a first frame and a second frame which is adapted to assume closing and opening positions with respect to the first frame;

a process cartridge detachably mountable into the main assembly and containing at least a photosensitive member and process means contributable to image formation on the photosensitive member;

optical means provided in said first frame for applying light information to the photosensitive member of said cartridge;

a member swingably supported in said second frame to deflect an optical path of the light information from said optical means;

positioning means provided in said first frame and engageable with said swingably supported member to position it, when said second frame assumes its closing position; and supporting means provided in said main assembly to detachably support said cartridge.

8. An apparatus according to claim 7, wherein said deflecting member includes a mirror.

9. An apparatus according to claim 8, wherein said mirror is mounted to an end of a spring.

10. An image forming apparatus, comprising:

a main assembly including a first frame and a second frame which is adapted to assume closing and opening positions with respect to the first frame;

a process cartridge detachably mountable into the main assembly and containing at least a photosensitive member and process means contributable to image formation on the photosensitive member;

optical means provided in said first frame for applying light information to the photosensitive member of said cartridge;

a positioning member provided in said first frame and engageable with said cartridge when said second frame assumes its closing position;

supporting means provided in said second frame to detachably support said cartridge;

a deflecting member swingably provided in said second frame to deflect an optical path of the light information from said optical means; and positioning means provided in said first frame and engageable with said deflecting member to position it when said second frame assumes its closing position.

11. An apparatus according to claim 10, wherein the photosensitive member of said cartridge is in the form of a drum, and wherein said positioning means is engageable with a rotational shaft of said photosensitive member.

12. An apparatus according to claim 10, wherein said deflecting means includes a mirror.

13. An apparatus according to claim 10, wherein said optical means includes a laser scanner.

14. An apparatus according to claim 10, wherein said optical means includes an imaging lens and an original illuminating lamp.

15. An apparatus according to claim 10, wherein a spring member is provided in said second frame to urging said process cartridge, when loaded, toward said positioning member.

16. An apparatus according to claim 10, wherein said process cartridge is inserted into and retracted from in the direction substantially perpendicular to the central axis of the opening and the closing of said second frame.

17. An apparatus according to claim 10, wherein said positioning means integrally supports a transfer charger.

18. An apparatus according to claim 10, wherein said positioning means integrally supports a transfer charger and a transfer material guide.

* * * * *

UNITED STATES PATENT AND TRADEMARK OFFICE

CERTIFICATE OF CORRECTION

PATENT NO. :4,873,548

DATED :October 10, 1989

INVENTOR(S) :HIROO KOBAYASHI, ET AL.

It is certified that error appears in the above-identified patent and that said Letters Patent is hereby corrected as shown below:

COLUMN 1

Line 22, "electrophotographhic" should read --electrophotographic--.

Line 56, "bottom," should read --bottom--.

COLUMN 3

Line 6, "transfer charter 5." should read --transfer charger 5.--.

COLUMN 5

Line 19, "frame," should read --frame.--.

COLUMN 6

Line 53, "claim 3" should read --claim 3,--.

--

UNITED STATES PATENT AND TRADEMARK OFFICE

CERTIFICATE OF CORRECTION

PATENT NO. : 4,873,548

DATED : October 10, 1989

INVENTOR(S) : HIROO KOBAYASHI, ET AL.

It is certified that error appears in the above-identified patent and that said Letters Patent is hereby corrected as shown below:

COLUMN 8

Line 30, "urging" should read --urge--.

Signed and Sealed this

Nineteenth Day of November, 1991

*Attest:*

HARRY F. MANBECK, JR.

*Attesting Officer*

*Commissioner of Patents and Trademarks*